US006792787B1

(12) United States Patent
Coalson

(10) Patent No.: US 6,792,787 B1
(45) Date of Patent: Sep. 21, 2004

(54) PRESS TRANSFER HAVING A CLUTCH DRIVE DISCONNECT

(75) Inventor: Glen Coalson, Troy, MI (US)

(73) Assignee: HMS Products, Co., Troy, MI (US)

( * ) Notice: Subject to any disclaimer, the term of this patent is extended or adjusted under 35 U.S.C. 154(b) by 0 days.

(21) Appl. No.: 10/401,934

(22) Filed: Mar. 27, 2003

(51) Int. Cl.[7] ..... B21D 43/05

(52) U.S. Cl. ..... 72/405.16; 72/405.09; 72/1; 72/4; 198/621.1; 192/150

(58) Field of Search ..... 72/405.13, 405.16, 72/405.09, 405.01, 1, 4; 198/621.1; 192/150

(56) References Cited

U.S. PATENT DOCUMENTS

| | | | | | |
|---|---|---|---|---|---|
| 3,738,503 | A | * | 6/1973 | Wallis | 198/773 |
| 3,756,425 | A | * | 9/1973 | Wallis | 198/621.1 |
| 4,032,018 | A | * | 6/1977 | Wallis | 198/621.1 |
| 4,513,602 | A | * | 4/1985 | Sofy | 72/405.13 |
| 4,540,087 | A | * | 9/1985 | Mizumoto | 198/621.1 |
| 4,557,154 | A | * | 12/1985 | Iwata et al. | 74/89.21 |
| 4,702,363 | A | * | 10/1987 | Sofy | 192/150 |
| 4,833,908 | A | | 5/1989 | Sofy | |
| 4,852,381 | A | | 8/1989 | Sofy | |
| RE34,581 | E | | 4/1994 | Sofy et al. | |
| 5,802,967 | A | * | 9/1998 | Thudium et al. | 100/207 |
| 6,050,124 | A | | 4/2000 | Shiroza | |
| 6,116,075 | A | | 9/2000 | Sofy | |
| 6,134,939 | A | | 10/2000 | Sofy | |
| 6,216,523 | B1 | | 4/2001 | Sofy et al. | |

* cited by examiner

*Primary Examiner*—Daniel C. Crane
(74) *Attorney, Agent, or Firm*—Howard & Howard

(57) ABSTRACT

A workpiece transfer assembly (12, 112) moves workpieces through a press (10) and includes a pair of spaced pulleys (42) and an endless belt (43) entrained about the pulleys (42) and a clamp (46) connecting the belt (43) to a trolley (34, 134) for horizontally moving a pair of trolleys (34, 134) and the arms (24, 124) supported thereby. The clamp (46) is clamped to one reach of the endless belt (43) for moving back and forth along the between the pulleys (42). A biasing device (56) urges a male cam member (52) into driving engagement with a female cam member (54) to connect the belt (43) and the arms (24, 124) and allows the cam members (52 and 54) to react with one another in a camming fashion to move out of the driving engagement to allow the belt (43) to move without moving the arms (24, 124) in response to the predetermined force resisting movement of the arms (24, 124).

12 Claims, 5 Drawing Sheets

PRESS TRANSFER HAVING A CLUTCH DRIVE DISCONNECT

BACKGROUND OF THE INVENTION

1. Field of the Invention

The invention relates to a workpiece transfer assembly for a press of the type including a reciprocating member and a series of longitudinally spaced in-line stations wherein each station is a further progression of the workpiece forming process.

2. Description of the Prior Art

Such a transfer assembly comprises at least one horizontal carrier beam, a vertical drive system for moving the carrier beam between various vertical positions along a vertical axis on a press, at least one horizontal arm extending transversely to the carrier beam for supporting and moving a transfer bar into and out of the press, and a horizontal drive system for moving the arm into and out of the press along a transverse horizontal axis extending transversely to the carrier beam and for moving the arm along a longitudinal axis extending longitudinally and parallel to the carrier beam. The horizontal drive system to which the subject invention applies includes a pair of spaced pulleys and an endless belt entrained about the pulleys along a drive axis and a connection connecting the belt and the arm for moving the arm along one of the axes in response to movement of the belt.

In the event a problem arises within the press to prevent or interfere with normal or programmed movement of the transfer bar and/or arms that support the transfer bar, damage can occur to the horizontal drive system, particularly the electric drive motor, which can burn out if forced to stop while having drive power applied thereto.

SUMMARY OF THE INVENTION AND ADVANTAGES

The subject invention improves the connection between the belt and the arm for moving the arm along one of the axes in response to movement of the belt. In accordance with the subject invention, the connection is characterized by including a detent mechanism for snapping out of engagement in response to a predetermined force whereby the belt is disconnected from the arm in response to a predetermined force resisting movement of the arm by the drive system.

Accordingly, the subject invention prevents damage to the horizontal drive components, including the motor, or the arm or the transfer bar carried by the arm. This damage is prevented as the detent mechanism allows movement of the arm and transfer bar supported thereby to stop in response to a predetermined force of resistance while allowing the motor, etc., of the horizontal drive system to continue to move until it would normally stop.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 2:
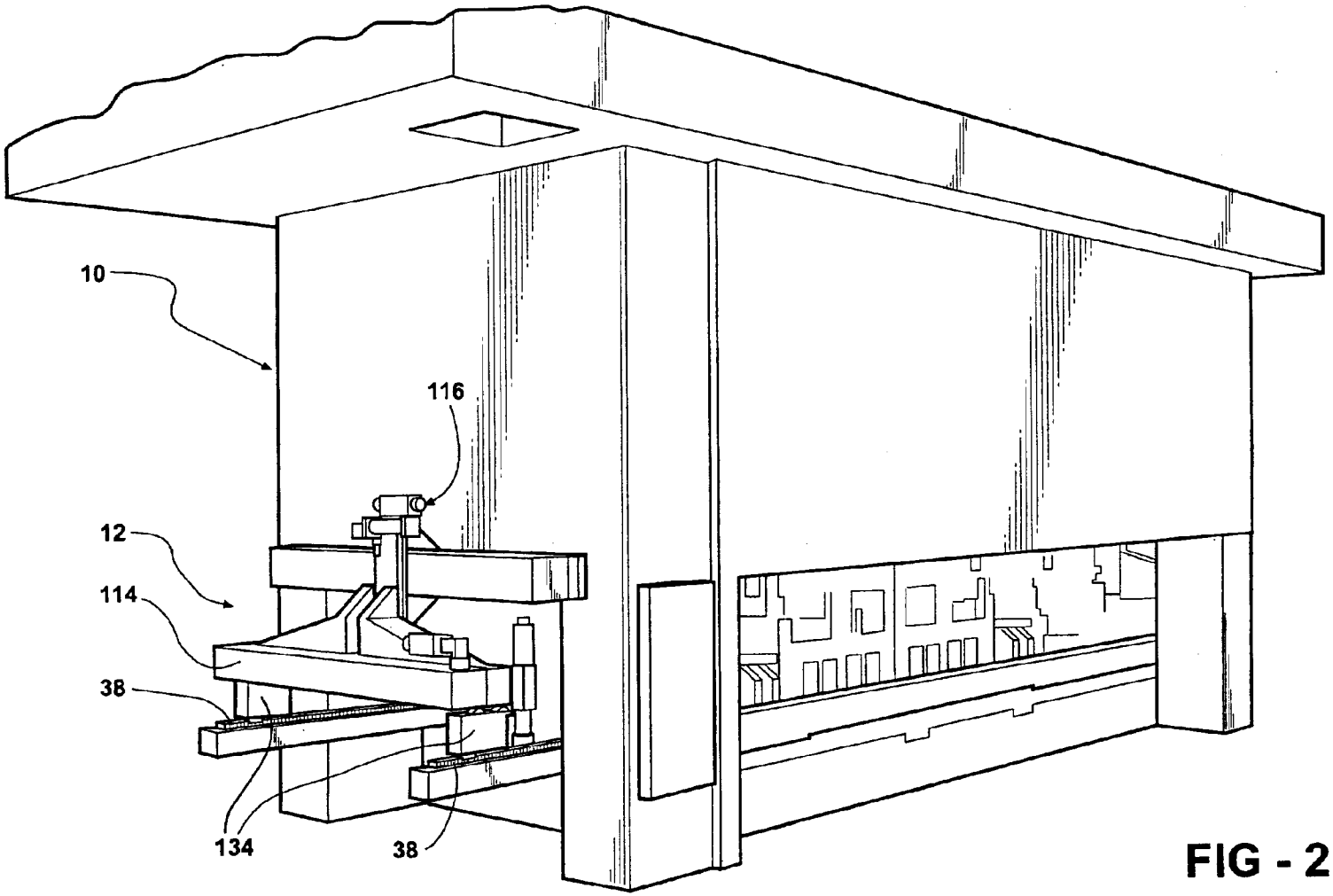
FIG. 2 is perspective view of a second embodiment of a workpiece transfer assembly incorporating the subject invention and mounted on a press.
Figure 3:
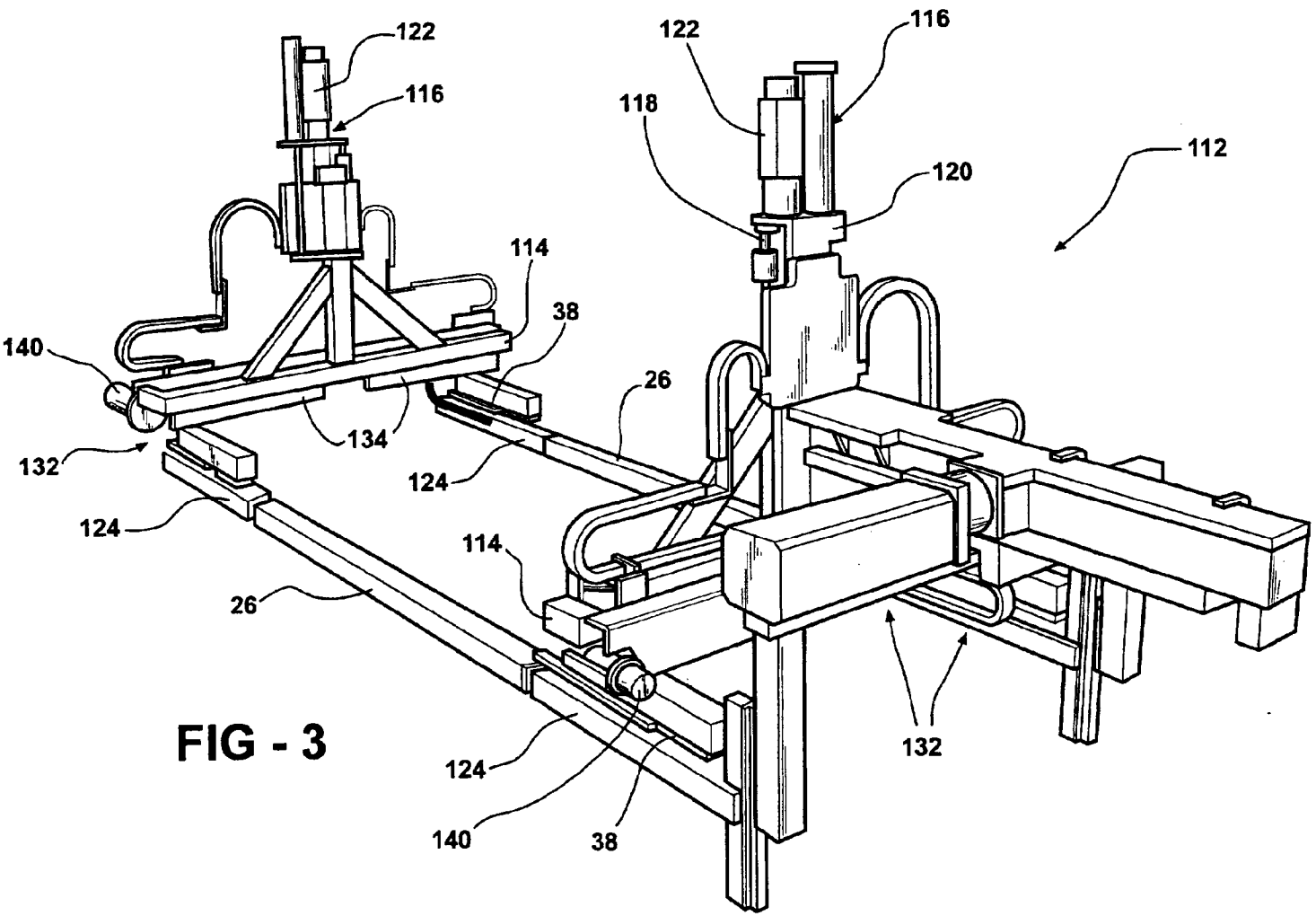
FIG. 3 is a perspective view of the second embodiment from the opposite end from the end shown in FIG. 2.
Figure 4:
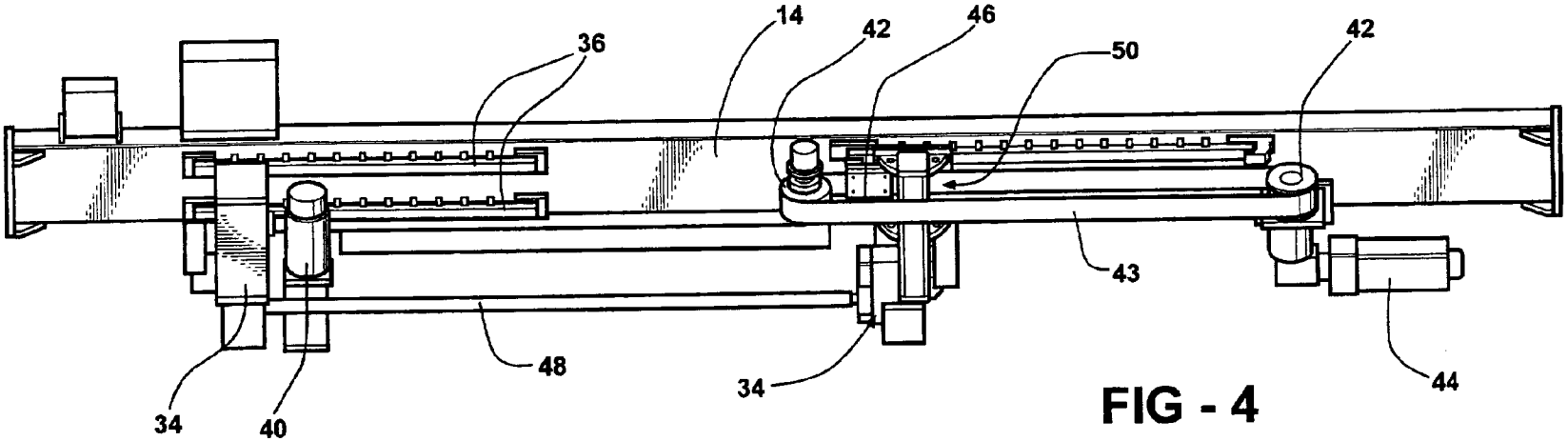
FIG. 4 is a perspective view from the side of the subject invention.

Referring to the Figures, wherein like numerals or numerals separated by one hundred indicate like or corresponding parts throughout the several views, a press is shown at is generally 10 and is of the type including a reciprocating member and a series of longitudinally spaced in-line stations wherein each station is a further progression of the workpiece forming process. A workpiece transfer assembly for moving workpeices through the press 10 is generally shown at 12 in FIGS. 1 and 46 and at 112 in FIGS. 2 and 3.

The transfer assembly 12 and 112 includes a pair of horizontal carrier beams 14, 114 that extend along the longitudinal axis of the press 10 on either side or at either end of the press 10. A vertical drive system, generally indicated at 16, 116, is included for moving the carrier beams 14, 114 between various vertical positions along a vertical axis on the press 10. The vertical drive system 16, 116 includes vertical screws 18, 118 extending vertically between bearing boxes 20, 120 mounted on the press 10 and rotated by vertical drive motors 22, 122.

Figure 1:
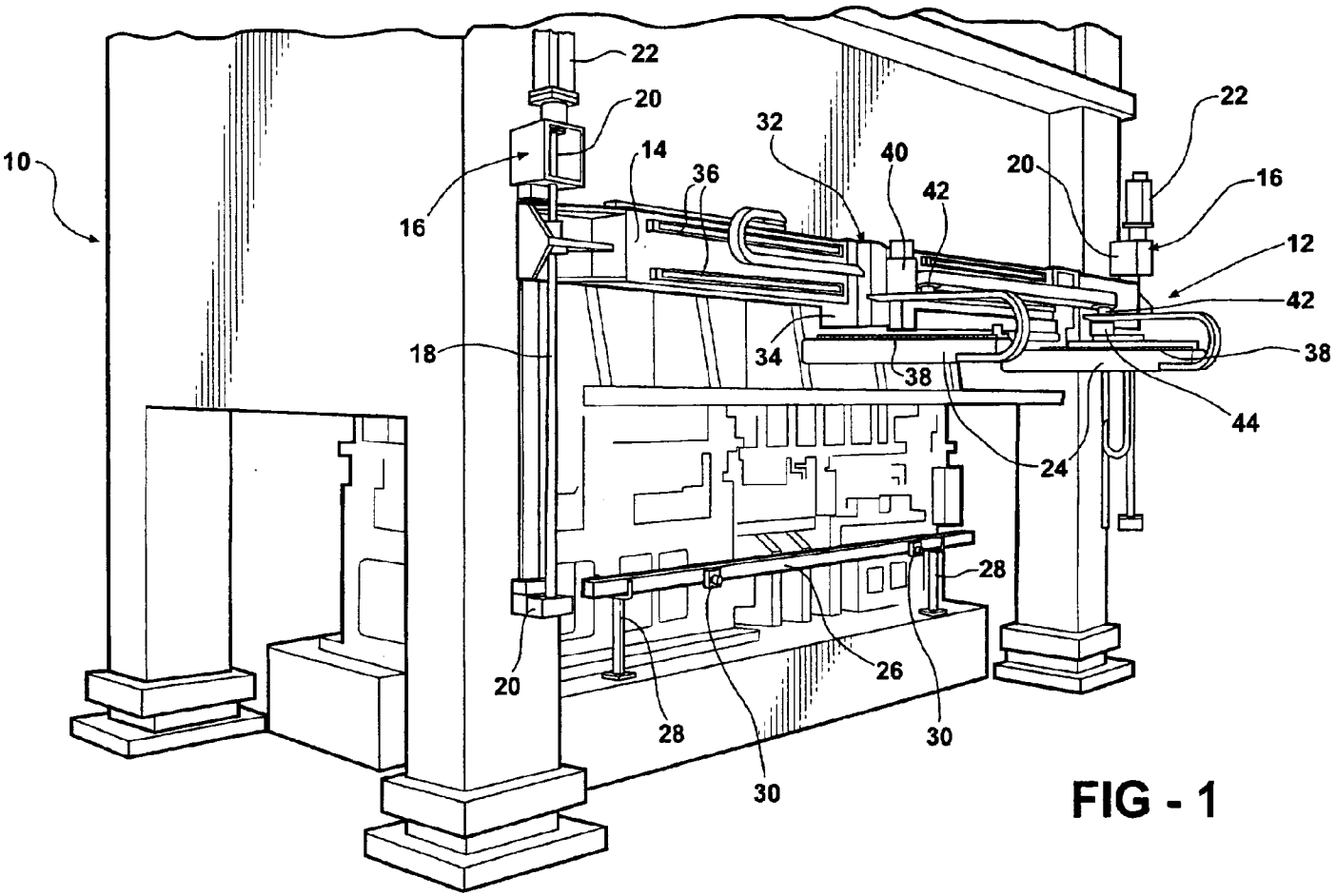
FIG. 1 is perspective view of a first embodiment of a workpiece transfer assembly incorporating the subject invention and mounted on a press.
Figure 7:
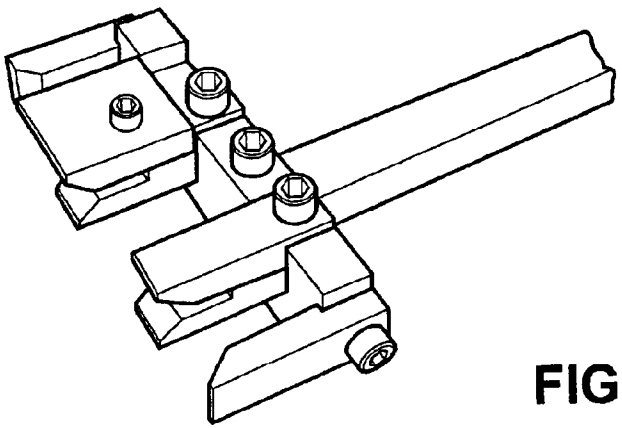
FIG. 7 is a perspective view of a sample group of fingers that could be used in such a workpiece transfer assembly for engaging and moving a workpeice.

A pair of horizontal arms 24, 124 extend transversely to each of the carrier beams 14, 114 for supporting and moving a transfer bar 26 into and out of opposite sides of the press 10. In the embodiment of FIG. 1, the transfer bar 24 is shown resting on stations 32, 132 and is connected to the horizontal arms 24 via connectors 30. Fingers or the like as shown in FIG. 7, extend from the transfer bars 26 to engage workpieces and the fingers change configuration for each different part being processed through the press 10.

A horizontal drive system generally shown at 32, 132 is included for moving the arms 24, 124 into and out of the press along a transverse horizontal axis extending transversely to the transfer bars 26 and for moving the arms 24, 124 along the longitudinal axis of the press 10 that extends longitudinally and parallel to the transfer bars 24. The horizontal drive system 32, 132 includes a pair of trolleys 34, 134 suspended from each carrier beam 14, 114 by a pair of longitudinal rails or tracks 36 and a pair of transverse rails or tracks 38 suspend the arms 24, 124 from the trolleys 34, 134. A transverse drive motor 40, 140 is connected via a drive shaft to a rack and pinion drive associated with each transverse track 38 for moving the arms 24, 124 along one of the horizontal X and Y axes of the press 10.

The horizontal drive system 32, 132 also includes a pair of spaced pulleys 42 and an endless belt 43 entrained about the pulleys 42 along a drive axis and a connection connecting the belt 43 and the arms 24, 124 via the trolleys 34, 134 for moving the arms 24, 124 along one of the axes in response to movement of the belt 43. As will be appreciated by those skilled in the art, the belt 43 and connection may be used to move the arms 24, 124 into and out of the press 10 instead of the rack and pinion, i.e., along anyone of the axes. Accordingly, the pulleys 42 are mounted directly or indirectly on the carrier beam 14, 114 by support flanges in spaced relationship to one another and a longitudinal drive motor 44 rotates the pulleys 42 by rotating at least one of the pulleys 42. A clamp 46 is clamped to one reach of the endless belt 43 for moving back and forth relative to the carrier beam 14, 114 between the pulleys 42, either parallel or transverse to the carrier beam 14, 114. A connection, generally indicated at 50, connects one of the trolleys 34, 134 to the clamp 46 and the trolleys 34, 134 are interconnected by a connecting rod 48 for moving in unison with the clamp 46.

Figure 5:
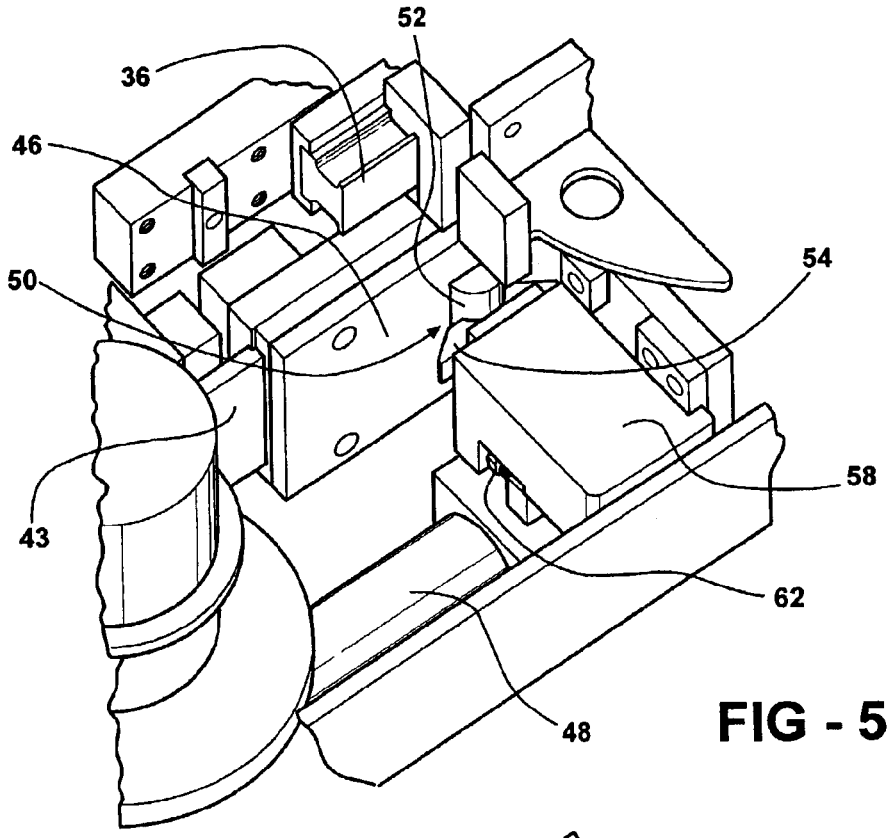
FIG. 5 is a fragmentary perspective view of the subject invention in the engaged position.
Figure 6:
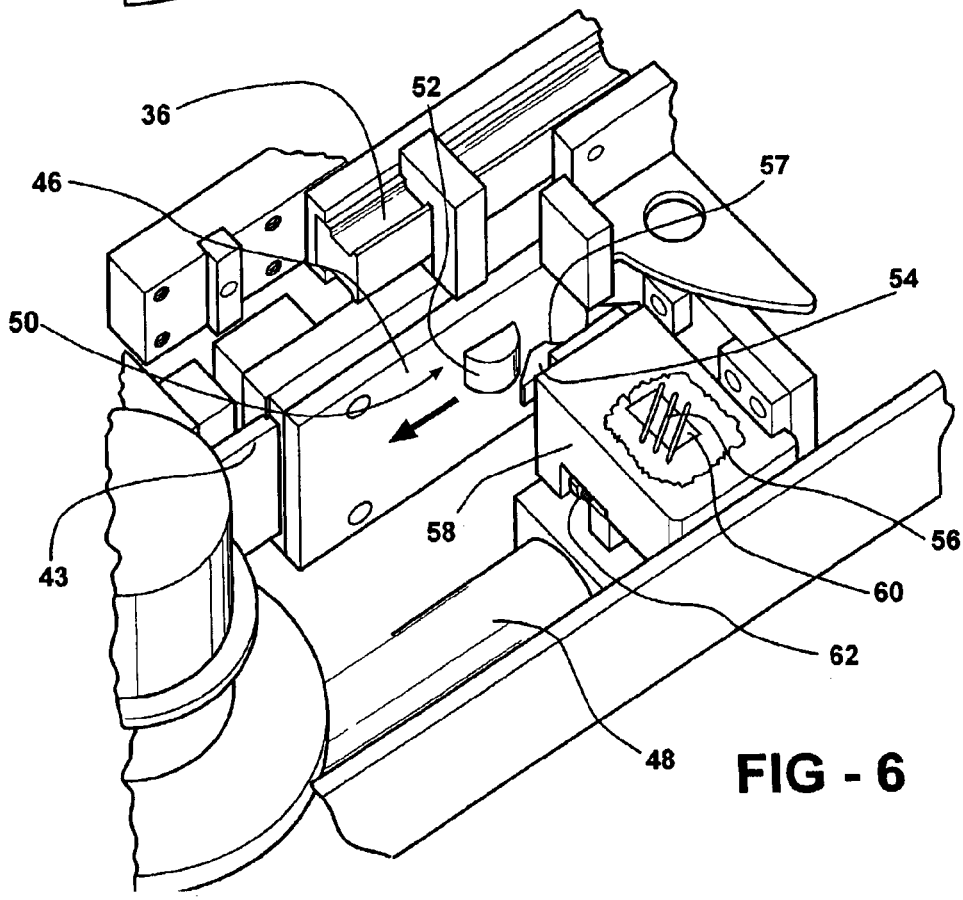
FIG. 6 is a fragmentary perspective view of the subject invention in the disengaged position.

As illustrated in FIGS. 5 and 6, the connection 50 is characterized by including a detent mechanism for snapping out of engagement in response to a predetermined force whereby the belt 43 is disconnected from the trolley 34, 134 and, therefore, the arms 24, 124 in response to a predetermined force resisting movement of the arms 24, 124 by the drive system. More specifically, the detent mechanism includes a male cam member 52 and a female cam member 54 in driving engagement with one another for connecting the belt 43 and the arm 24, 124, and a biasing device 56, in the form of a coil spring, for urging the cam members 52 and 54 into the driving engagement and for allowing the cam members 52 and 54 to react with one another in a camming fashion to move out of the driving engagement to allow the belt 43 to move without moving the arm 24, 124 in response to the predetermined force resisting movement of the arm 24, 124. The cam members 52 and 54 present camming surfaces inclined in a direction transverse to the drive axis of the belt 43 by being spherical. Accordingly, the male cam member 52 comprises a rod extending transversely to the drive axis of the belt 43 and having a semi-circular cross section and the female cam member 52 comprises a head having a semi-circular recess 57 (FIG. 6) for engaging the rod male cam member 52.

A head guide 58 movably supports and guides the female cam member 54 head into and out of engagement with the rod. The spring comprising the biasing device 56 is disposed to react between the head and the guide 58 for urging the female cam member 54 into engagement with the male cam member 52. A slide connection 60 is disposed between the female cam member 54 head and the guide 58 for guiding movement of the head relative to the guide 58 into and out of engagement with the rod defining the male cam member 52. As illustrated, the male rod cam member 52 is supported on the belt 43 and the support for the female cam member 54 head is connected to the arm 24, 124 via being mounted on the trolley 34, 134, however, it could be reversed.

There is also included an adjustment 62 for adjusting the position of the guide 58 to adjust the reaction force between the cam members 52 and 54. In other words, the compression or force exerted by the spring of the biasing device 56 can be adjusted by adjusting the position of the guide 58 relative to the trolley 34, 134 upon which it is supported.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

REFERENCE NUMERALS

10. Press
12, 112. Transfer assembly
14, 114. beam
16, 116. vertical drive system
18, 118. vertical screws
20, 120. bearing boxes
22, 122. vertical drive motors
24, 124. arm
26. transfer bar
32, 132. horizontal drive system
34, 134. trolley
36. longitudinal rails or tracks
38. transverse rails or tracks
40, 140. transverse drive motor
42. pulleys
42. belt
44. longitudinal drive motor
46. clamp
48. connecting rod
50. connection
52. male cam member
54. female cam member
56. biasing device
57. recess
58. head guide
60. slide connection
62. adjustment 6

What is claimed is:

1. A workpiece transfer assembly for a press of the type including a series of longitudinally spaced in-line stations wherein each station is a further progression of the workpiece forming process, said assembly comprising;

at least one horizontal carrier beam (14, 114)

a vertical drive system (16, 116) for moving said carrier beam (14, 114) between various vertical positions along a vertical axis on a press, at least one horizontal arm (24, 124) for supporting and moving a transfer bar (26) into and out of a press, a horizontal drive system (32, 132) for moving said arm (24, 124) into and out of said press along a transverse horizontal axis extending transversely to said transfer bar (26) and for moving said arm (24, 124) along a longitudinal axis extending longitudinally and parallel to said transfer bar (26), said horizontal drive system (32, 132) including a pair of spaced pulleys (42) and an endless belt (43) entrained about said pulleys (42) along a drive axis and a connection (50) connecting said belt (43) and said arm (24, 124) for moving said arm (24, 124) along one of said axes in response to movement of said belt (43), said connection (50) characterized by including a detent mechanism for snapping out of engagement in response to a predetermined force whereby said belt (43) is disconnected from said arm (24, 124) in response to a predetermined force resisting movement of said arm (24,124) by said drive system.

2. An assembly as set forth in claim 1 wherein said detent mechanism includes a male cam member (52) and a female cam member (54) in driving engagement with one another for connecting said belt (43) and said arm (24, 124) and a biasing device (56) for urging said cam members (52 and 54) into said driving engagement and for allowing said cam members (52 and 54) to react with one another in a camming fashion to move out of said driving engagement to allow said belt (43) to move without moving said arm (24, 124) in response to said predetermined force resisting movement of said arm (24, 124).

3. An assembly as set forth in claim 2 wherein said cam members (52 and 54) present camming surfaces inclined in a direction transverse to said drive axis of said belt (43).

4. An assembly as set forth in claim 3 wherein said male cam member (52) comprises a rod extending transversely to said drive axis of said belt (43) and having a semi-circular cross section.

5. An assembly as set forth in claim 4 wherein said female cam member (52) comprises a head having a semi-circular recess (57) for engaging said rod.

6. An assembly as set forth in claim 5 including a head guide (58) for movably supporting and guiding said head into and out of engagement with said rod, said biasing device (56) being reacting between said head and said guide (58).

7. An assembly as set forth in claim 6 including a slide connection (60) between said head and said guide (58) for guiding movement of said head relative to said guide (58) into and out of engagement with said rod.

8. An assembly as set forth in claim 7 wherein said rod is supported on said belt (43) and said guide (58) for said head is connected to said arm (24, 124).

9. An assembly as set forth in claim 8 including an adjustment (62) for adjusting the position of said guide (58) to adjust the reaction force between said cam members (52 and 54).

10. An assembly as set forth in claim 8 wherein said pulleys (42) are supported on said carrier beam (14, 114).

11. A workpiece transfer assembly for a press of the type including a reciprocating member and a series of longitudinally spaced in-line stations wherein each station is a further progression of the workpiece forming process, said assembly comprising;

a pair of horizontal carrier beams (14, 114)

a vertical drive system (16, 116) for moving said carrier beams (14, 114) between various vertical positions along a vertical axis on a press, a pair of horizontal arms (24, 124) for supporting and moving a transfer bar (26) into and out of opposite sides of a press, a horizontal drive system (32, 132) for moving said arms (24, 124) into and out of said press along a transverse horizontal axis extending transversely to said transfer bars (26) and for moving said arms (24, 124) along a longitudinal axis extending longitudinally and parallel to said transfer bars (26), said horizontal drive system (32, 132) including a pair of spaced pulleys (42) and an endless belt (43) entrained about said pulleys (42) along a drive axis and a connection (50) connecting said belt (43) and said arm (24, 124) for moving said arms (24, 124) along one of said axes in response to movement of said belt (43), said connection (50) characterized by including a male cam member (52) and a female cam member (54) in driving engagement with one another for connecting said belt (43) and said arm (24, 124) and a biasing device (56) for urging said cam members (52 and 54) into said driving engagement and for allowing said cam members (52 and 54) to react with one another in a camming fashion to move out of said driving engagement to allow said belt (43) to move without moving said arm (24, 124) in response to a predetermined force resisting movement of said arm.

12. An assembly as set forth in claim 11 wherein said male cam member (52) comprises a rod extending transversely to said drive axis of said belt (43) and having a semi-circular cross section and said female cam member (52) comprises a head having a semi-circular recess (57) for engaging said rod.

* * * * *